US006133890A

United States Patent [19]

Damiani

[11] Patent Number: 6,133,890

[45] Date of Patent: Oct. 17, 2000

[54] SELF-RESONANT FOLDED UNIPOLE ANTENNA

[76] Inventor: Sylvio Mauro Damiani, Rua Umburanas, 504, S. Paulo, 05464-000, Brazil

[21] Appl. No.: 09/264,562

[22] Filed: Mar. 2, 1999

[51] Int. Cl.[7] ..... H01Q 1/36

[52] U.S. Cl. ..... 343/890; 343/749; 343/846

[58] Field of Search ..... 343/890, 896, 343/749, 846, 891, 897; H01Q 1/36

[56] References Cited

U.S. PATENT DOCUMENTS

| | | | |
|---|---|---|---|
| 2,508,657 | 5/1950 | Toller-Bond | 343/896 |
| 3,001,194 | 9/1961 | Leppert | 343/896 |
| 5,673,055 | 9/1997 | Hansen | 343/890 |
| 5,835,067 | 11/1998 | Goodman | 343/722 |

*Primary Examiner*—Don Wong
*Assistant Examiner*—Hoang Nguyen

[57] ABSTRACT

A self-resonant vertically polarized folded unipole antenna for long wave (LW), medium wave (MW) broadcasting and for the 160 meter amateur radio band with a grounded tower connected to radially descending fold wires terminated near the base of the tower in an open polygonal ring, possibly a C-ring with a reactive load in series with this ring. This reactance cancels the reactive component of the antenna input impedance causing the input impedance to appear resistive at the feed point. This leads to outstanding linearity and bandwidth up to and possibly exceeding plus or minus 16 kHz, sometimes exceeding plus and minus 20 kHz. The antenna is particularly useful for AM broadcasting of high quality music with response capable of being better than that of FM.

10 Claims, 2 Drawing Sheets

SELF-RESONANT FOLDED UNIPOLE ANTENNA

CROSS-REFERENCE TO RELATED APPLICATIONS

Not Applicable.

REFERENCE TO A MICROFICHE APPENDIX

Not Applicable.

STATEMENT REGARDING FEDERALLY SPONSORED RESEARCH OR DEVELOPMENT

Not Applicable.

BACKGROUND OF THE INVENTION

According to the applicable U.S. patent Classification Definitions, this invention is classified as "CLASS 343, COMMUNICATIONS: RADIO WAVE ANTENNAS".

The Folded Unipole Antenna (also known as Folded Monopole Antenna) is a well known vertical type of antenna , formed by a vertical tower of constant cross section dressed with a set of so called fold-wires. The descend vertical fold-wires are all parallel to the tower, externally located and equidistant from the tower geometric center, from its top till the bottom of the tower, without making any electrical contact with the tower (except at the top of the tower, where the fold-wires are electrically connected to the tower structure). Near the ground area, the fold-wires are electrically connected together through an horizontal positioned "O" ring, made of conductive metal (generally copper tubing). The "O" ring is centered in relation to the center of the tower cross section polygon. The "O" ring is the feed point of the antenna. The base of the tower structure is electrically connected to ground.

It has been, along all these years to the designer, a serious difficulty pertaining to all types of antennas the reactance component of the antenna input impedance. The reactance certainly limits the antenna bandwidth (its inherent Q factor is high), it turns more difficult the design of the associated tuning unit, etc. The present invention, which applies to the folded unipole type of antenna, simply overcomes this mentioned difficulty by making the reactive component of the input impedance of the folded unipole antenna equals to zero, so turning the antenna self-resonant at the operating frequency, i.e., its input impedance is purely resistive.

The folded unipole antenna has application in Long Wave Broadcasting (commonly used in Europe), in MW Broadcasting, and in the Amateur Radio 160 meters band; the self-resonant type, object of this invention, will certainly improve the quality transmission on these services just mentioned, as well as other services that might adopt it.

BRIEF SUMMARY OF THE INVENTION

The self-resonance of the folded unipole antenna is achieved by two steps:

1) by not connecting the fold-wires at the base of antenna (near to ground terrain) to the "O" ring; in its place, one shall connect all the fold-wires through an horizontal (parallel to the soil) "C" ring; a C ring is a "not closed on itself" kind of ring;

2) by placing in series with the C ring a reactive load, or reactive loads, of the lumped type in a previous studied point (or points), being this point (or these points) located between adjacent dropping fold-wires.

DETAILED DESCRIPTION OF THE INVENTION

As mentioned in BRIEF SUMMARY OF THE INVENTION above, by interrupting the C ring in previous and determined point (or points) and inserting the calculated reactance load (or loads) in series with the C ring, and also being the arriving vertical fold-wires connected to the C ring at both ends of the reactance load (if calculated as so), one achieve to the condition for the Self-Resonance.

Then, the lumped reactance load (or loads) placed in series with the C ring is tuned up in order to bring the reactance part of the input impedance of the antenna down to zero ohms.

Figure 2:
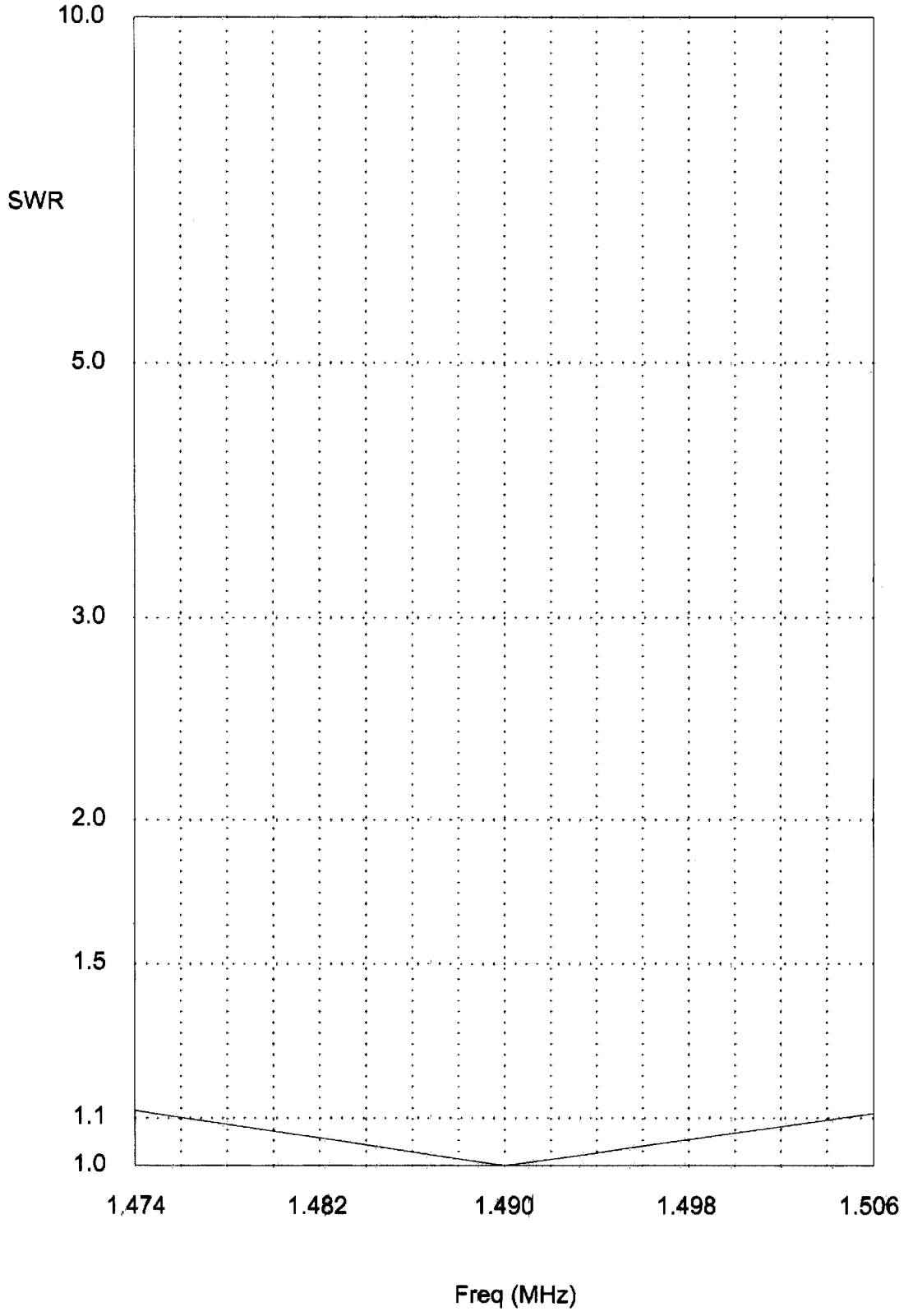
FIG. 2 shows the SWR plot as function of frequency of a Self-Resonant Folded Unipole Antenna, showing its splendid bandwidth for Broadcast transmission in AM. In the frequency range of ±12 kHz referenced to the central frequency, the SWR value is less than 1.1:1 in this example. Also, the SWR plot shows an excellent linearity throughout the operating band, being symmetric when viewed from the center frequency.

The invented improvement for the Folded Unipole Antenna [the C ring associated with the reactance load(s) and the final tuning of the load(s)], turns the antenna into a Self-Resonant one, and this will benefit the modulated signal transmitted with a superb sound quality when AM Broadcasting (LW or MW ), as one can easily preview by just examining carefully the SWR plot of FIG. 2.

Figure 1:
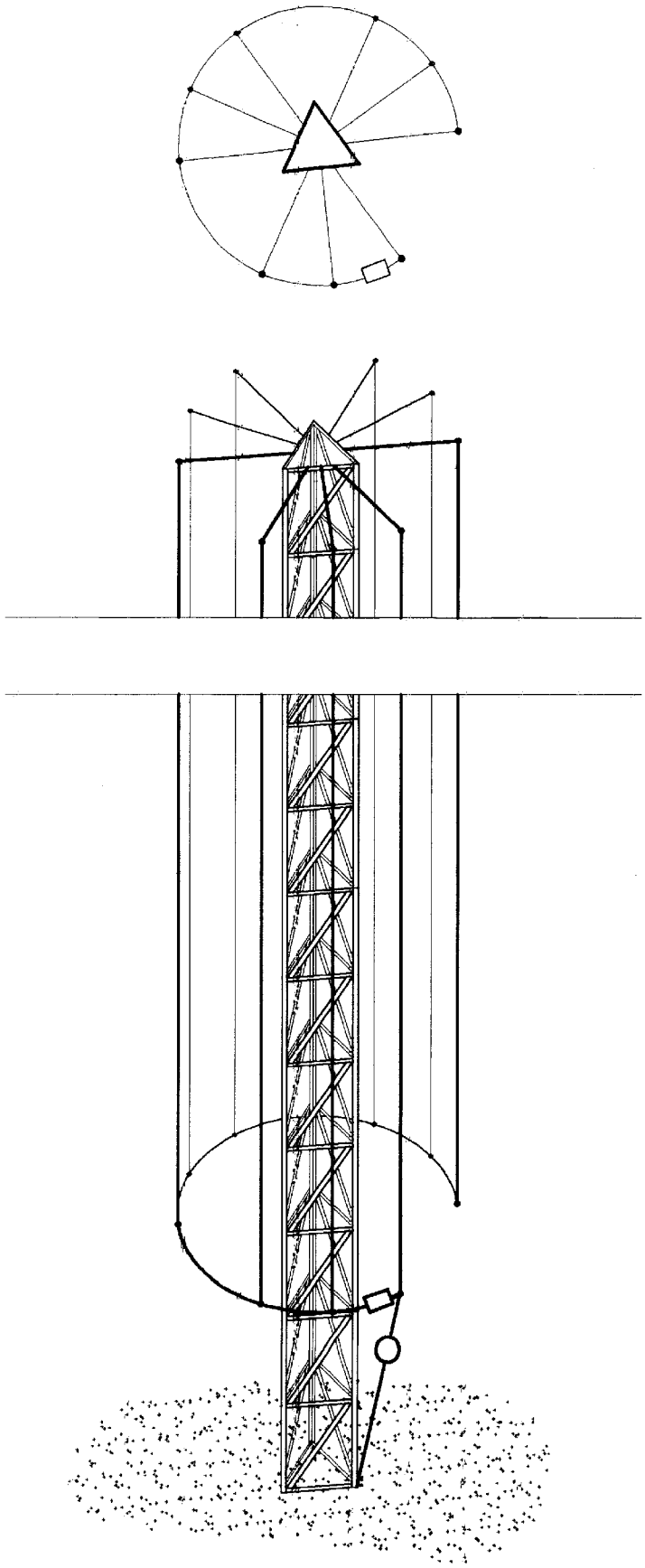
FIG. 1 shows details of the antenna base, near ground, where the C ring is applied to the electric closure of the several fold-wires. The central portion of this computer drawing represents the steel tower. Also shown is the lumped reactive load (shown as a small red rectangle), located between two fold-wires and in series with the C ring. The signal source is shown as a red circumference.

One word must be said about the number of fold-wires complementing this type of antenna: the condition for self-resonance is better achieved when one design at least 3.n fold-wires, where n is the number of sides of the regular polygon seen at the cross section of the support tower. FIG. 1 shows a 9 fold-wire model, being the tower a guyed constant triangular cross section In summary, the reactance load(s) installed in series with the C ring change the RF current phase distribution along the vertical fold-wires, in such a manner as to result in the cancellation of the reactive portion of the antenna's input impedance.

What is claimed is:

1. A self-resonant folded antenna comprising, in combination:

a central tower with upper and lower ends, said tower grounded at its lower end;

a plurality of fold wires extending radially downward from the upper end of said tower, each of said fold wires connected to the upper end of said tower;

an open polygonal ring concentric to said tower located near the lower end of said tower, said ring terminating each of said fold wires;

a radio frequency drive point located on said polygonal ring, said drive point having a drive point impedance;

a reactive load connected in series with said polygonal ring, said reactive load chosen to make said drive point impedance resistive.

2. The self-resonant antenna of claim 1 wherein said open polygonal ring is a C-ring.

3. The self-resonant antenna of claim 1 wherein said open polygonal ring is a V-ring.

4. The self-resonant antenna of claim 1 wherein said open polygonal ring is an n-sided polygon, where n is a number of fold wires, said polygon having one side missing.

5. The self-resonant antenna of claim 1 wherein said reactive load is located on said open polygonal ring between a pair of fold wires.

6. The self-resonant antenna of claim 1 further comprising additional reactive loads located on said open polygonal ring.

7. An antenna of the type known as a folded monopole used in AM broadcasting, this antenna having an input impedance at a drive point, the invention comprising a grounded vertical tower extending upward from ground with a top connected to a system of fold wires, the fold wires located radially around the tower and extending downward and outward, the fold wires terminated near the ground in an open conductive ring concentric to the tower and extending around it, the ring being circular or polygon with a reactive load connected in series with the ring, this reactive load tuned to cancel any reactive component in the input impedance.

8. The antenna of claim 7 wherein the drive point is on the concentric ring.

9. A method of increasing the bandwidth of a monopole antenna comprising the steps of:

grounding a tower at a lower end;

connecting a system of fold wires to an upper end;

extending said fold wires downward to an open ring concentric to said tower;

placing a reactive load in series with said open ring;

choosing a value of said reactive load to make input impedance resistive.

10. The method of claim 9 further comprising the step of placing the reactive load between two fold wires.

* * * * *